United States Patent [19]

Murakami et al.

[11] Patent Number: 5,016,677

[45] Date of Patent: May 21, 1991

[54] AUTOMATIC COP CHANGING DEVICE FOR A WEAVING MACHINE

[75] Inventors: Fumio Murakami, Saitama; Sadaaki Okazaki, Tokyo; Takayoshi Aoyagi, Kanagawa; Tokuji Iwasaki, Chiba; Tetsuya Konno, Kanagawa, all of Japan

[73] Assignee: Nippon Felt Co., Ltd., Tokyo, Japan

[21] Appl. No.: 443,609

[22] Filed: Nov. 29, 1989

[30] Foreign Application Priority Data

Dec. 7, 1988 [JP] Japan ..... 63-309598
Dec. 7, 1988 [JP] Japan ..... 63-309599

[51] Int. Cl.[5] ..... D03D 45/20

[52] U.S. Cl. ..... 139/245; 139/1 R; 139/224 R; 139/241

[58] Field of Search ..... 139/1 R, 224 R, 245, 139/241, 246; 57/275; 219/230; 414/225; 242/35.5 A; 901/31

[56] References Cited

U.S. PATENT DOCUMENTS 3,228,431 1/1966 Merki ..... 139/245
4,063,635 12/1977 Heckel ..... 139/245 X
4,106,973 8/1978 Wright ..... 219/230 X
4,877,061 10/1989 Yarita et al. ..... 139/1 R X

*Primary Examiner*—Andrew M. Falik
*Attorney, Agent, or Firm*—Marshall & Melhorn

[57] ABSTRACT

An automatic cop changing device for a weaving machine in which a shuttle carrying a cop consisting of a bobbin around which a weft is wound is reciprocated between warps so as to weave the weft between the warps, comprising: a cop positioning unit for securing the shuttle stationary near a terminal point of its reciprocating movement when the weft of a current cop mounted on the shuttle is consumed by more than a precribed amount; a cop storage unit for storing a plurlaity of new cops; a robot arm carrying a weft gripping hand for drawing the weft from the current cop and a weft from one of the new cops stored in the cop storage unit, and crossing the two wefts, a cop engaging hand for moving the cop in the shuttle between its upright position and its retracted position, and a cop gripping hand for removing the old cop from the shuttle and carrying the new cop into the shuttle; a weft tying unit for tying the crossed part of the wefts; and a weft trimming unit for trimming an extraneous part of the tied weft. This device permits quick replacement of cops without causing undue strain on the weft. The advantageous use of a robot arm permits a compact and simple design of the entire device.

16 Claims, 7 Drawing Sheets

AUTOMATIC COP CHANGING DEVICE FOR A WEAVING MACHINE

TECHNICAL FIELD

The present invention relates to a device for changing cops for a weaving machine in which a shuttle detachably carrying a cop consisting of a wooden bobbin having a weft wound thereon is reciprocated laterally between warps, and in particular to an automatic cop changing device for a weaving machine which can automatically carry out a series of actions including the action of positioning the shuttle at a prescribed location, the action of tying the weft of the current cop which has been used up by more than a prescribed amount with the weft of a next new cop, and the action of removing the current cop from the shuttle and mounting the next cop on the shuttle.

BACKGROUND OF THE INVENTION

For instance, in a paper making machine, water is removed from wet pulp by pressing it between a pair of opposing rollers, and such rollers consist of press felt in the form of relatively broad endless belts. The press felt is made by entangling fibers of a pad consisting of layers of woolen or synthetic fiber web with a ground fabric by needling. During the weaving process of the ground fabric, the warps are set on a warp beam and fed continuously while the weft is supplied by a cop mounted on a shuttle. Therefore, when weaving such a broad ground fabric for making press felt, the cop is required to be changed to a new one every time the shuttle has reciprocated from one lateral end to the other by a certain number of times. Further, at the same time, the weft of the old cop and the weft of the new cop must be connected with each other by welding or the like.

Conventionally, changing cops and connecting the ends of two wefts together were carried out manually. As a result, an experienced operator was required for each weaving machine, and its was difficult to reduce the cost of weaving.

BRIEF SUMMARY OF THE INVENTION

In view of such problems of the prior art, a primary object of the present invention is to provide a device for automatically changing cops for a weaving machine which is adapted to be automated.

A second object of the present invention is to provide a device for changing cops for a weaving machine which is simple in structure so as to be economical to fabricate and free from failures during its operation.

A third object to the present invention is to provide such a cop changing device which is compact enough to be incorporated into an existing weaving machine designed for manual replacement of cops.

A fourth object of the present invention is to provide such a cop changing device which can replace cops with minimum time and can reduce the chance of weft breakage at the same time.

According to the present invention, these and other objects can be accomplished by providing an automatic cop changing device for a weaving machine in which a shuttle carrying a cop consisting of a bobbin around which a weft is wound is reciprocated between warps so as to weave the weft between the warps, comprising: cop positioning means for keeping the shuttle stationary near a terminal point of its reciprocating movement when the weft of a current cop mounted on the shuttle is consumed by more than a prescribed amount; cop storage means for storing a plurality of new cops; weft pulling means for drawing the weft from the current cop and a weft from one of the new cops stored in the cop storage means, and crossing the two wefts; weft tying means for tying the crossed part of the wefts; weft trimming means for trimming an extraneous part of the tied weft; and cop replacing means for removing the current cop from the shuttle, and mounting the new cop on the shuttle.

Thus, by positioning the shuttle, drawing out the weft from the cop which has been used up by more than a prescribed amount, tying it with the weft of the next cop which is stored in the storage means, and changing the cop with the cop replacing means for expelling the old cop from the shuttle and mounting the next cop on the shuttle, it is possible to eliminate the need for an operator always attending the weaving machine. The tying means may consist of an ultrasonic, high frequency or other welding unit.

Preferably, the device is equipped with slack removing means for taking up slack from the tied weft after the new cop is mounted on the shuttle and before the shuttle is shot from the terminal point of its reciprocating movement to another terminal point so that the breakage of the weft may be prevented through elimination of sudden tensioning of the weft. According to a preferred embodiment of the present invention, the slack removing means comprises a stationary ring placed adjacent to a part of the weft from the new cop, a gripper which can selectively grip the weft from inside the stationary ring and release it as required, and gripper driving means for selectively moving the gripper away from and towards the stationary ring.

According to a preferred arrangement of the weft pulling means which permits the entire cop changing device to be compact enough to be accommodated in a limited space and, if necessary, to incorporate this automatic cop changing device into an existing weaving machine, the weft pulling means comprises a table, a weft gripping hand carried by a robot which can grip an end of the weft of the new cop stored in the cop storage means and a part of the weft extending from the current cop, a pair of locating pins projecting upright from the table to cross the wefts at three points by passing the wefts along different sides of the locating pins in a crisscross manner with the weft gripping hand, disengaging arms placed under the wefts between the locating pins to selectively disengage the wefts from the locating pins by pushing off the weft from the locating pins.

When the woven fabric consists of press felt for removing water from paper web during a paper making process, it is important to spread the tied points of the weft over the entire fabric in order to avoid creating flaws in the produced paper. To achieve this goal, it is preferred that the weft pulling means comprises tied point varying means for changing the point of tying by changing the length of a span of the weft between the tied point of the weft and the current cop. According to a preferred embodiment of the present invention, the tied point varying means comprises a stationary rod projecting upright from the table, a moveable rod projecting upright from the table so as to be able to move toward and away from the stationary rod to change the tied point relative to the cop at its terminal point, and means of retracting the rods into the table to disengage the weft therefrom.

According to a particularly advantageous aspect of the present invention, the cop replacing means comprises a robot arm having a cop raising hand for moving a cop between its retracted position in the shuttle and its upright position in the shuttle, and a cop gripping hand for gripping a cop and carrying it between its upright position in the shuttle and its storage position in the cop storage means. For instance, the cop may be pivotally and detachably supported at its base end by the shuttle so as to be pivotable between its upright position and its retracted position, and the cop raising hand may comprise a spherical head which is adapted to engage a free end of the cop and move it between its upright position and its retracted position.

According to another particularly advantageous aspect of the present invention, the cop raising hand and the cop gripping hand are mounted on a same robot arm as the weft gripping hand, and the weft gripping hand comprises a pair of pawls which are pivotally connected to each other by a pivot shaft to grip a weft between the pawls, and the spherical head of the cop raising hand is formed at an end of the pivot shaft.

BRIEF DESCRIPTION OF THE DRAWINGS

Now the present invention is described in the following in terms of a specific embodiment with reference to the appended drawings, in which.

DETAILED DESCRIPTION OF THE PREFERRED EMBODIMENT

Figure 1:
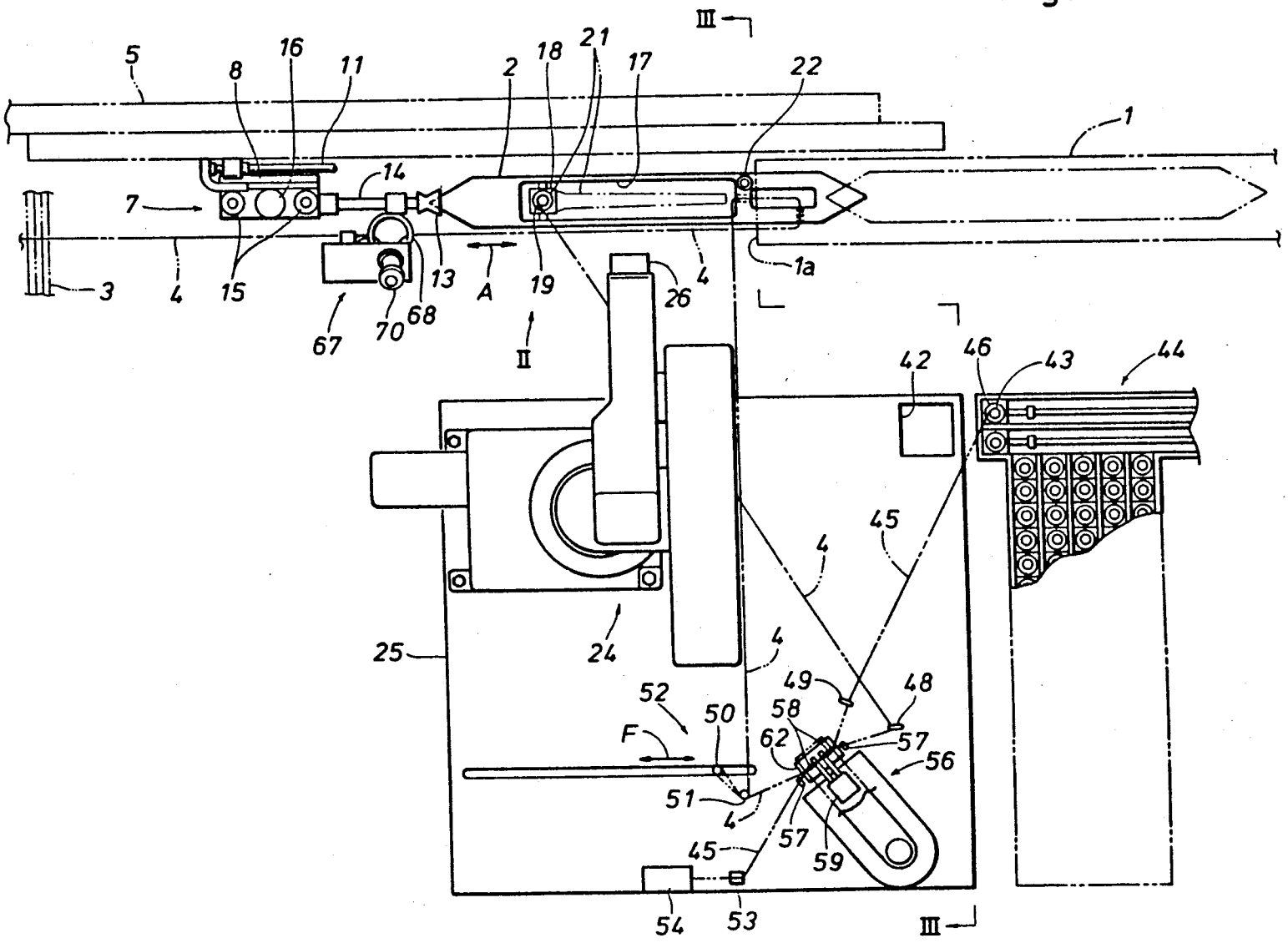
FIG. 1 is a general plan view showing the device for automatically changing cops for a weaving machine according to the present invention.

FIGS. 1 through 4 show an embodiment of the cop changing device according to the present invention which may be used for weaving the ground fabric for the press felt to be used for making paper. A sheet of ground fabric is woven on the left hand side of the arrangement illustrated in FIGS. 1 and 2, and a pair of shuttle boxes are placed on either side of this arrangement although only the shuttle box 1 on the right hand side is illustrated. A shuttle 2 is shot from the shuttle box 1 by a hammer unit not shown in the drawing, and is shot back from the other shuttle box in such a manner that the ground fabric may be woven by using a reed and leasing machine (a device for engaging the warp of the reed) while the shuttle 2 reciprocates in the direction indicated by the arrow A in the drawing between the warps 3 to weave a weft 4 between the warps 3. The shuttle boxes 1 are provided with brake units for the shuttle 2. Each shuttle box 1 may contain a plurality of shuttles carrying different kinds of weft so that they may be used interchangeably to obtain a desired property of the woven fabric.

Figure 2:
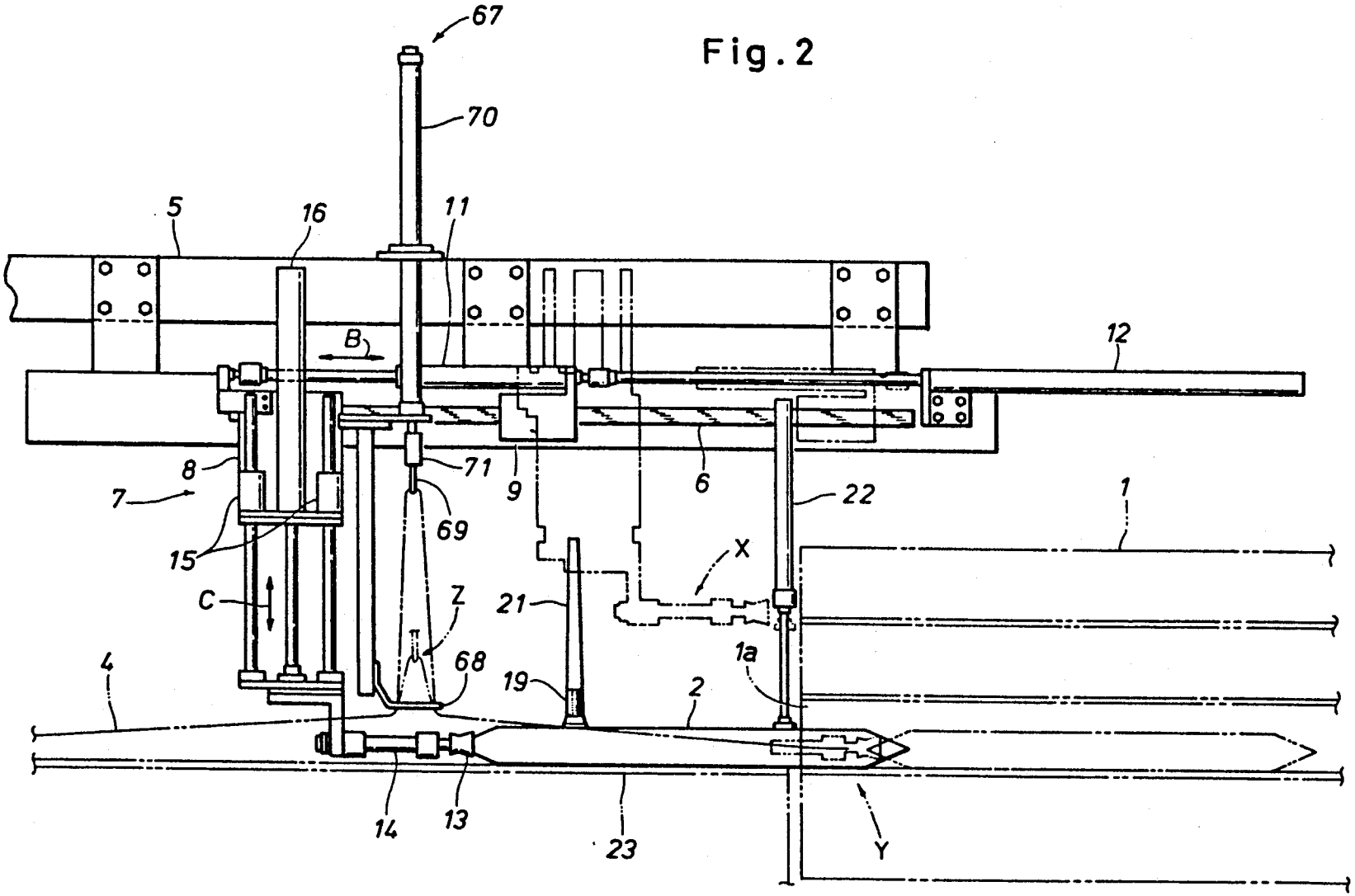
FIG. 2 is a front view as seen from the arrow lines II—II of FIG. 1.

A fixed frame 5 consisting of a channel member is disposed along the direction of the movement of the shuttle 2, and a moveable base 8 for a shuttle positioning unit 7 is slidably supported by a slide rail 6 extending on the fixed frame 5 as illustrated in FIG. 2. The moveable base 8 can move in the direction indicated by the arrow B in FIG. 2 at two different strokes as described hereinafter by means of a small air cylinder 11 which coupled with the moveable base 8 at its free end and fixedly secured to a moveable bracket 9 supported by the slide rail 6 in the same manner as the moveable base 8 at its base end, and a large air cylinder 12 which is coupled with the moveable bracket 9 at its free end and fixedly secured to the fixed frame 5 at its base end. The shuttle positioning unit 7 carried by the moveable base 8 guides an arm portion 14, carrying a suction pad 13 at its free end for engaging a front end portion of the shuttle 2 by vacuum, so as to be able to move in the vertical direction indicated by the arrow C in FIG. 2 by way of a pair of guide rods 15, and is driven by an air cylinder 16 along the vertical direction in FIG. 2. The suction pad 13 is coupled with a vacuum generator not shown in the drawings.

A slot 17 of a middle part of the shuttle 2 receives therein a wooden bobbin 21 which is detachably fitted on a tongue 18 at its one end. The tongue 18 is pivotally supported by the shuttle 2 at an end of the slot 17 so as to permit a pivotal movement of the wooden bobbin 19 into and out of the slot 17. A cop 19 consisting of this wooden bobbin 21 around which a weft 4 is wound is retained in the slot 17 in a horizontal condition or in its retracted position as indicated by the imaginary lines in FIG. 1 during the flight of the shuttle 2, and the weft 4 unwound from the cop 19 is fed out from a shuttle eye provided on one side of the shuttle 2.

When the shuttle 2 has reciprocated a prescribed number of times and the weft 4 stored in the cop 19 has been consumed beyond a prescribed amount, the shuttle positioning unit 7 pulls out the shuttle 2, which has reached a terminal point of its reciprocating movement and has been held stationary in the shuttle box 1 by the brake unit not shown in the drawing, to the position indicated by the solid lines in FIG. 2 by engaging the front end of the shuttle 2 by suction and the shuttle 2 is placed on a support base 23 so that the cop 19 or the current cop 19 may be replaced with a new one as described hereinafter. To prevent the rear end of the shuttle 2 from being lifted from this position, a securing air cylinder 22 is mounted on a part of the fixed frame not shown in the drawing. The shuttle 2 is thus positioned adjacent to a gate 1*a* of the shuttle box 2 situated at a terminal end of the flight path of the shuttle 2 when the cop 19 is to be replaced.

Figure 5:
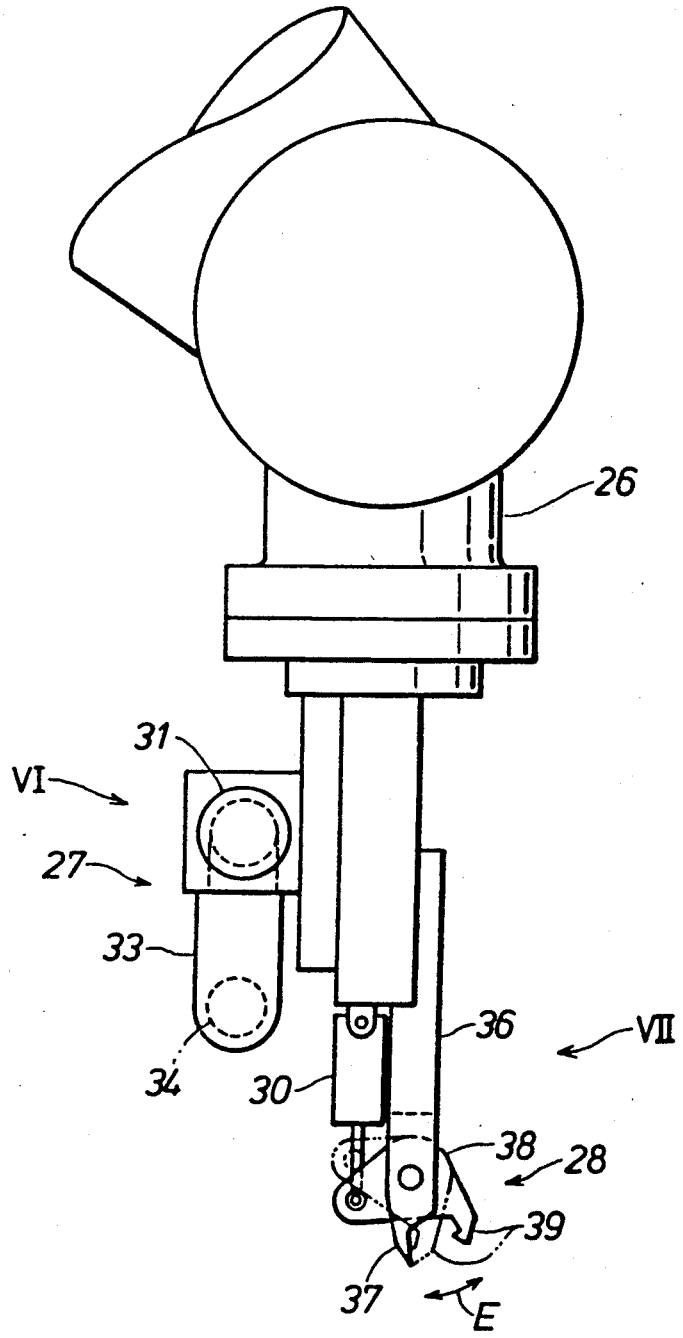
FIG. 5 is an enlarged view of an essential part of the device showing the arm portion of the robot.
Figure 6:
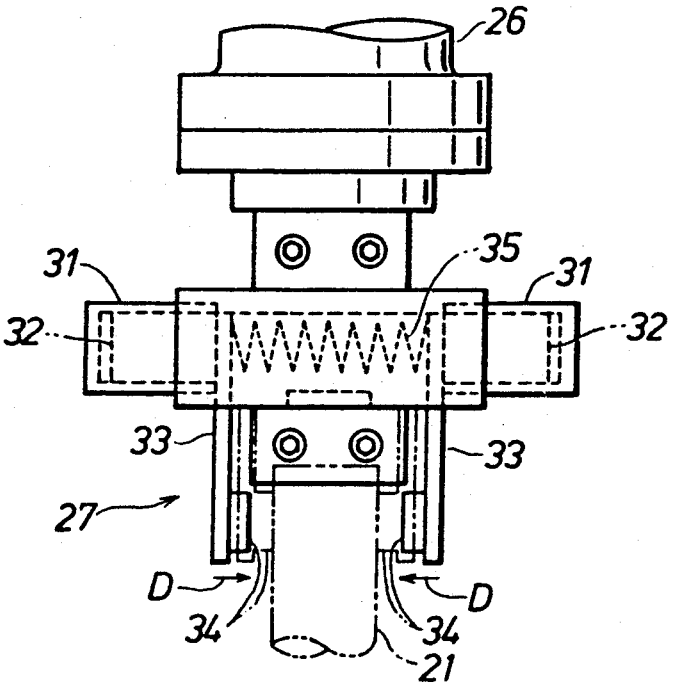
FIG. 6 is an end view as seen from arrow VI of FIG. 5.
Figure 7:
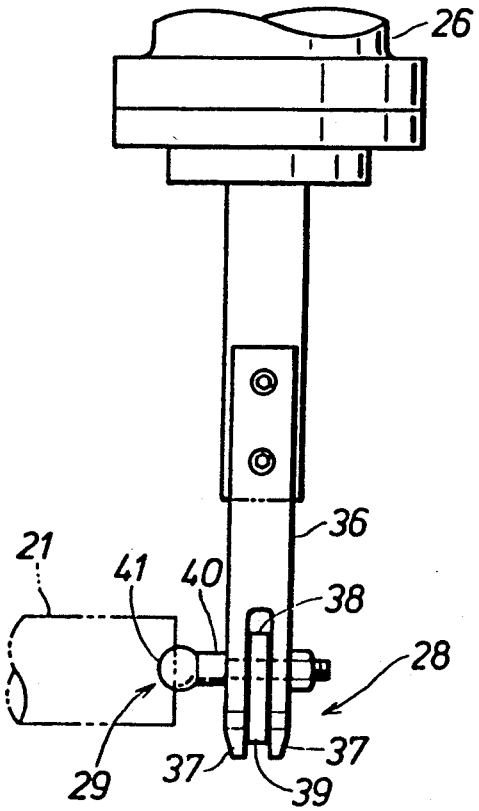
FIG. 7 is an end view as seen from arrow VII of FIG. 5.

As shown in FIG. 1, a multi-link robot 24 is mounted on a common table 25 which is disposed on one side of the thus positioned shuttle 2. As illustrated in FIGS. 5 and 6, the robot 24 is provided at the free end of its single arm 26, with a wooden bobbin gripping hand 27 which can clamp the free end of the wooden bobbin 21, a weft gripping hand 28 which can engage the weft 4, and a wooden bobbin engaging hand 29 which can engage with an opening provided at the free end of the wooden bobbin as illustrated in FIG. 7.

The wooden bobbin gripping hand 27 comprises a pair of air cylinders 31 disposed coaxially and opposite to each other, a pair of arm portions 33 which are each secured to the piston 32 of the corresponding one of the air cylinders 31 and extend downward as seen in FIG. 6 in parallel with each other, and pads 34 attached to the opposing surfaces of the free ends of the arm portions 33. A return coil spring 35 is interposed between the two pistons 34 to elastically urge the arm portions 33 away from each other to the positions for non-active state as indicated by the solid lines in FIG. 6. In active state, the two arm portions 33 are driven in the direction indicated by the arrow D in FIG. 6, and can clamp the free end of the wooden bobbin 21 with their pads 34 as indicated by the imaginary lines in FIG. 6.

The weft gripping hand 28 comprises a fixed pawl 37 formed at the free end of a fixed hand 36 and a moveable hand 38 having a moveable pawl 39. The moveable hand 38 is rotatably supported by a pivot shaft 40 extending across a slot formed in the fixed hand 36, and the moveable pawl 39 can be closed and opened by an air cylinder 30 in the direction indicated by the arrow E. The wooden bobbin engaging hand 29 is provided with a spherical head 41 integrally formed at one end of the pivot shaft 40 fixedly secured to the fixed hand 36, and can engage with an opening provided at the free end of the wooden bobbin 21 as illustrated in FIG. 7.

An ejection chute 42 is provided in an upper right corner of the common table 25 as seen in FIG. 1 to remove used cops 19, and a cop storage unit 44 is provided to the right of the common table 25 to store new cops 43 which are going to be used. Each of the new cops 43 comprises a new wooden bobbin 46 around which a new weft 45 that is to be connected to the old weft 4 is wound, and is stored in an appropriate part of the cop storage unit 44.

At the lower right corner of the common table 25, as seen in FIG. 1, is disposed a weft tying unit 47 for connecting the old weft 4 with a new weft 45. Adjacent to this weft tying unit 47 are disposed a hook 48 for guiding the weft 4 taken out from the cop 19 mounted on the shuttle 2 to the weft tying unit 47, and another hook 49 for similarly guiding the new weft 45 taken out from the new cop 43 stored in the cop storage unit 44. The common table 25 also carries a guide rod 51 for guiding the weft 4 taken out from the shuttle 2 to the weft tying unit 47 from a side opposite to the hooks 48 and 49. The common table 25 further carries, each at a suitable location, a tying point varying unit 52 including a moveable guide rod 50 which can move along the direction indicated by the arrow F in FIG. 1 in either direction to change its position relative to the guide rod 51 so that the point of tying the old weft 4 and the new weft 45 may be shifted relative to each other, a clamp unit 53 for supporting the free end of the new weft 45, and a trimmed weft recovery unit 54 for recovering an extraneous part of the new weft 45 which has been tied to the weft 4.

Figure 3:
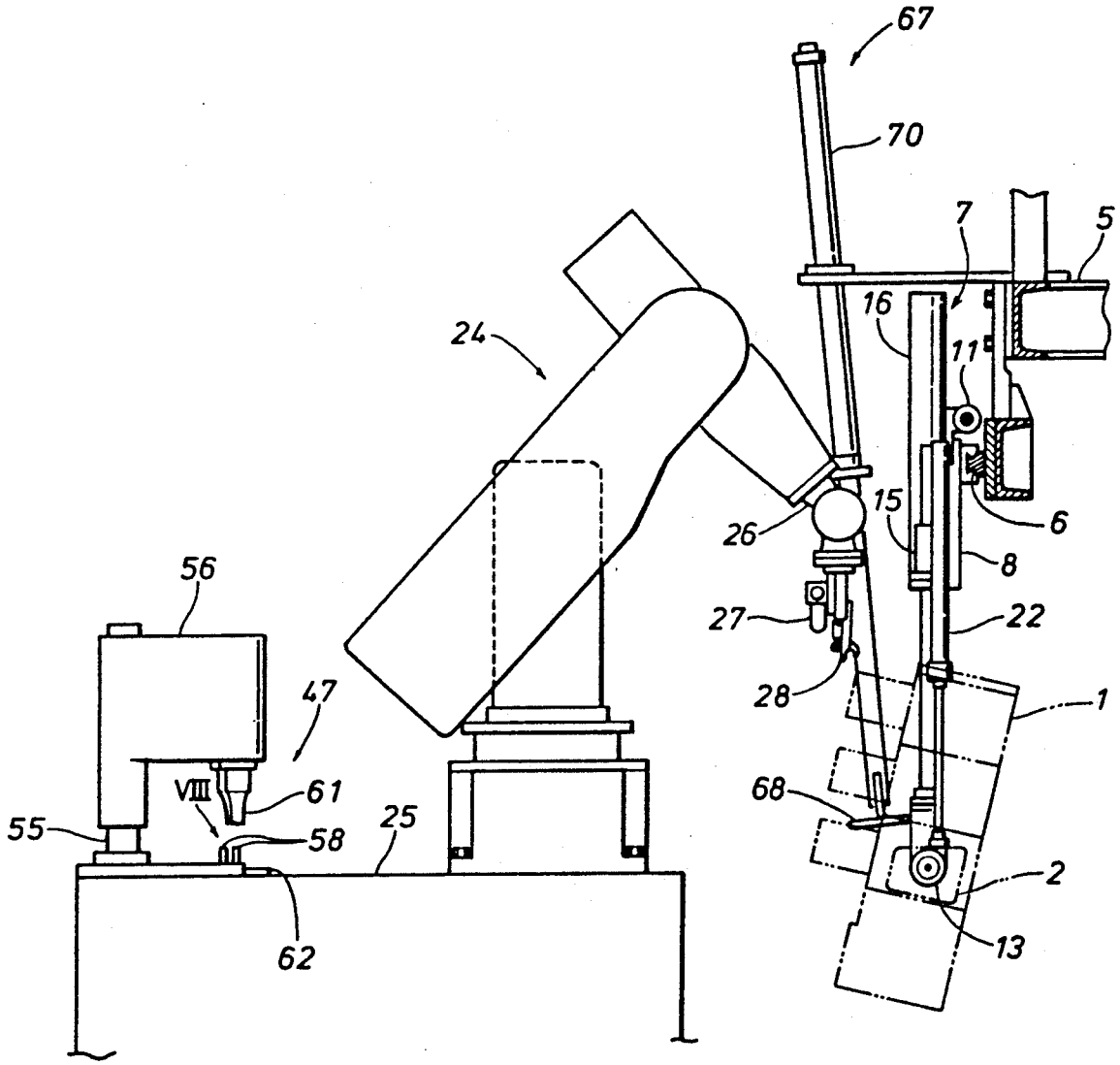
FIG. 3 is a side view of an essential part of the device as seen from the arrow lines III—III of FIG. 1.
Figure 4:
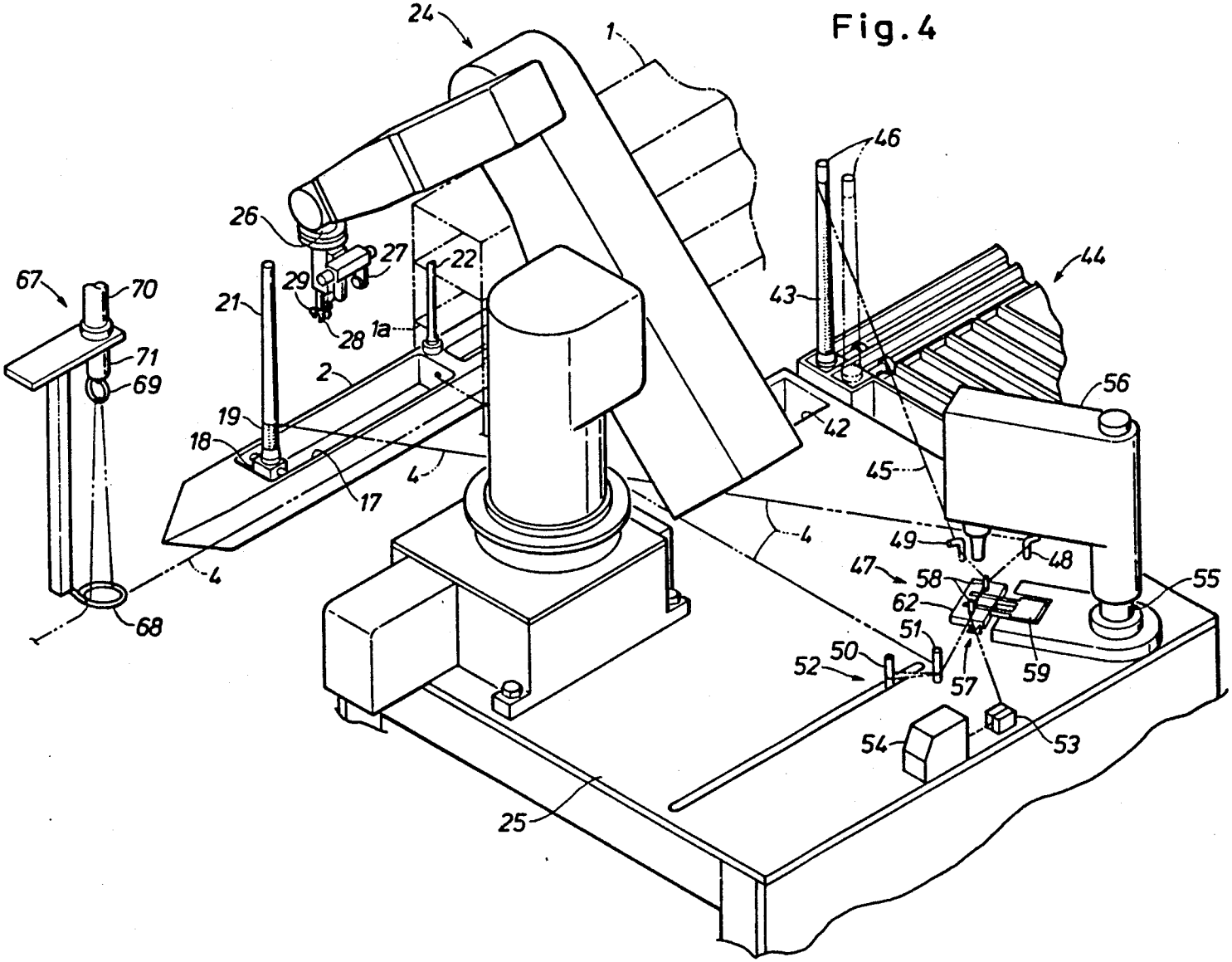
FIG. 4 is a perspective view of an essential part of the device.
Figure 8:
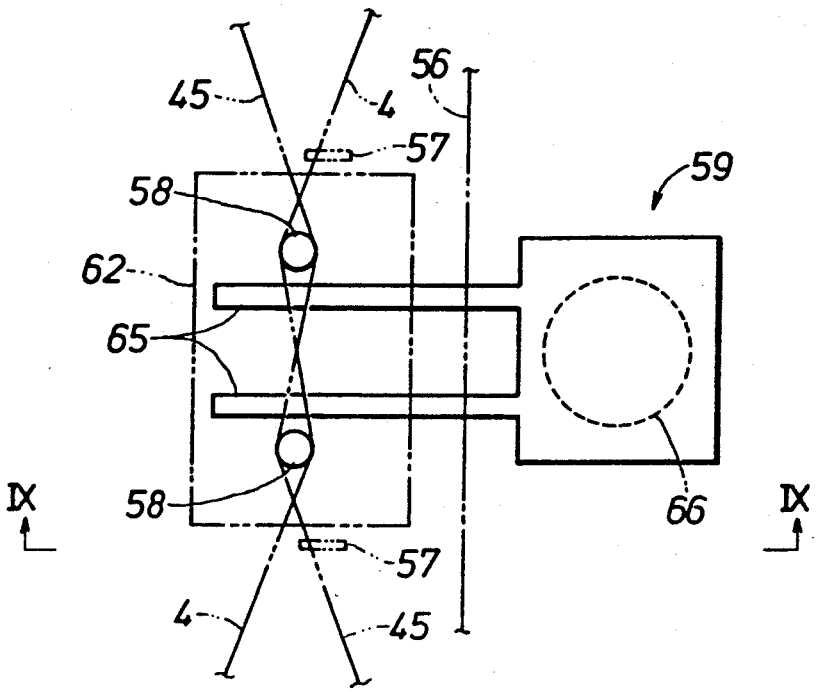
FIG. 8 is a plan view as seen from arrow VIII of FIG. 3.
Figure 9:
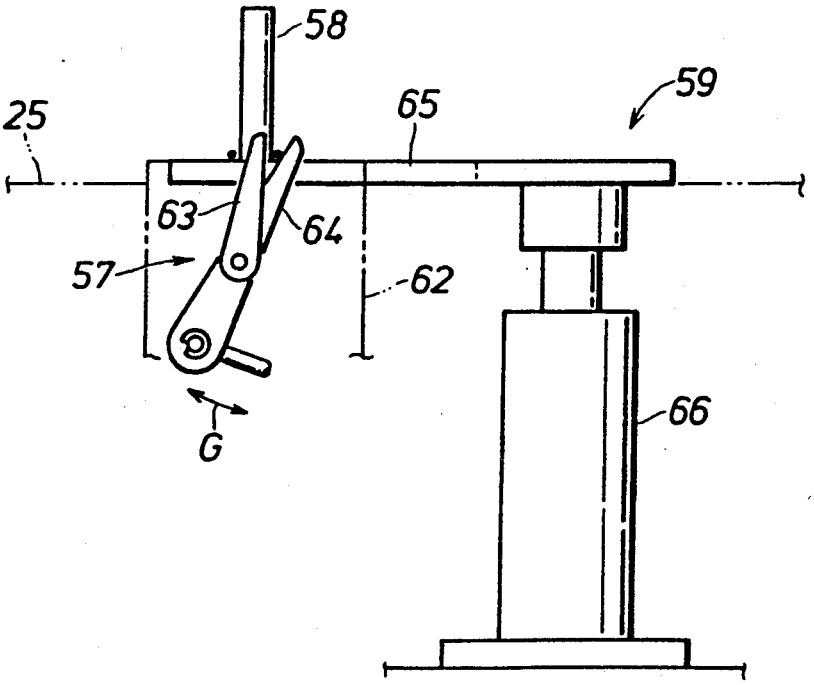
FIG. 9 is a side view of an essential part as seen from line IX—IX of FIG. 8.

The aforementioned weft tying unit 47 consists of an ultrasonic or high frequency welder 56 which can move vertically by means of a support shaft 55 securely mounted upright on the common table 25 as best shown in FIGS. 3 and 4, a pair of locating pins 58 for crossing the weft 4 and the new weft 45 at three points as best shown in FIGS. 8 and 9, weft trimmers 57 for severing the used-up cop from the current weft and trimming an extraneous part of the weft after it has been tied, and a remover 59 for disengaging the current weft 4 and the new weft 45 from the locating pins 58 after they are tied up together into a single weft. The main body of the welder 56 which is supported by the support shaft 55 in the manner of a cantilever is provided with a welding horn 61 which can move downwards from the lower end surface of the main body and upwards thereto, and an anvil 62 for the welder 56 is mounted on a part of the common table 25 associated with the welding horn 61 so that the three crossing points of the weft 4 and the new weft 45 passed across the locating pins 58 may be gripped between the welding horn 61 and the anvil 62 to weld the wefts together.

The weft trimmers 57 are provided on either side of the anvil 62, and each of them is constructed as a shear having a fixed blade 63 and a moveable blade 64 so that the old cop 19 may be severed from the current weft 4 or an extraneous part of the weft 45 of the new cop 46 may be trimmed, as the case may be, by driving the moveable blade 64 in the direction indicated by the arrow G in FIG. 9 by means of an air cylinder or the like which is not shown in the drawings. The remover 59 is provided with a pair of parallel arm portions 65 which are located below the tied points of the weft 4 and the new weft 45 to remove the connected weft from the locating pins 58 after it has been tied up, and an air cylinder 66 fixedly secured to the common table 25 to vertically drive the arm portions 65.

According to the automatic cop changing device which has been described above, the shuttle 2 which has been kept stationary at a prescribed location, the new cops 43 stored in the cop storage unit 44, and the aforementioned units mounted on the common table 25 are located within the moveable range of the arm 26 of the robot 24. The aforementioned units are automatically activated according to a work flow which has been programed by a control unit such as a sequencer not shown in the drawings, and an optical sensor for detecting the amount of the weft remaining on the cop, and a limit switch for detecting breakage of the weft 4 are arranged at appropriate locations as sensors required for such automatic operation of the device.

A slack preventing unit 67 is mounted on a fixed frame not shown in the drawings to prevent any slack in the part of the weft 4 extending between the ground fabric and the shuttle 2 when the weft 4 is taken out from the shuttle 2. This slack preventing unit 67 is provided with a fixed ring 68, and a gripper 69 which can grip the weft 4 from inside the fixed ring 68 as illustrated in FIGS. 2 and 4. The gripper 69 is coupled with the free end of the piston rod of an air cylinder 70 via an actuator 71 for opening and closing the gripper 69 so that it may be able to be driven vertically in either direction by the air cylinder 70.

Now the operation of the above described device is now described in the following.

First of all, the free end of the new weft 45 taken out from the new cop 43 stored in the cop storage unit 44 is gripped and pulled out by the weft gripping hand 28 and is hooked upon the hook 49. Thereafter, the new weft 45 is passed across the locating pins 58 in a zig-zag manner, and the free end of the new weft 45 is fitted into the trimmed weft recovery unit 54 by way of the clamp unit 53, thus setting the new weft 45 in the state illustrated in FIG. 1.

While the shuttle 2 is flying, the shuttle positioning unit 7 keeps the air cylinder 16 in its retracted state and stays in its waiting condition with the small air cylinder 11 in its extended state and the large air cylinder 12 in its retracted state, as indicated by the arrow X in FIG. 2.

After the shuttle 2 has reciprocated a prescribed number of times, the shuttle 2 is held stationary in the shuttle box 1, and, by extending the air cylinder 16 while the small air cylinder 11 is kept in its extended state and the large air cylinder 12 kept in its retracted state, the arm portion 14 is brought into alignment with the gate 1*a* of the shuttle box 1. Then, the small air cylinder 11 is retracted to engage the suction pad 13 with the free end portion of the shuttle 2 as indicated by the arrow Y in FIG. 2, and the shuttle 2 is pulled out to the position indicated by the solid lines in the drawing by engaging the front end portion of the shuttle 2 by the suction pad 13 by suction and extending both the air cylinders 11 and 12. Thereafter, the piston rod of the securing air cylinder 22 is lowered from its waiting position indicated by the imaginary lines in FIG. 2 onto the upper surface of the shuttle 2 to locate and fix the shuttle 2 against the support base 23. The slack removal unit 67 is then activated and the gripper 69 is pulled up to the positioning indicated by the arrow Z to remove slack in the part of the weft 4 extending between the shuttle 2 and the ground fabric.

Then, the arm 26 of the robot 24 is activated so as to raise up the wooden bobbin 21 by engaging the opening at the free end of the wooden bobbin 21 lying in the shuttle 2 with the wooden bobbin engaging hand 29, and so as to pull out the part of the weft 4 adjacent to the cop 19 by gripping and pulling it with the weft gripping hand 28. The weft 4 which has been pulled out from the cop 19 is hooked around the fixed guide rod 51 and the moveable guide rod 50 of the tying point changing unit 52, passed across the locating pins 58, and then hooked around the hook 48 to thereby set up the weft 4 as illustrated in FIG. 1.

Then, the welding horn 61 is lowered to weld the three intersections of the weft 4 and the new weft 45 which have been set up as illustrated in FIG. 8 by clamping them against the anvil 62. Thereafter, the old cop 19 is severed from the current weft 4 and an extraneous part of the weft 45 of the new cop 43 is trimmed by the weft trimmers 57 to thereby complete the connection of the weft 4 with the new weft 45 as a single continuous weft. When the welding horn 61 is lifted up, the welded parts of the old weft 4 and the new weft 45 are disengaged from the locating pins 58 by the remover 59.

Since the tying points of the old and new wefts would appear along a same row in the ground fabric if they were tied at regular interval, the present device changes the position of the moveable guide rods 50 relative to the fixed guide rod 51 appropriately in order to disperse the knots produced by these tying points over the entire ground fabric.

Upon completion of the process of tying the wefts together, the wooden bobbin 21 is pulled out from the tongue 18 of the shuttle 2 by gripping the wooden bobbin 21 with the wooden bobbin gripping hand 28 of the robot 24, and is removed out into the ejection chute 42. The wooden bobbin gripping hand 28 then grips a new wooden bobbin 46 stored in the wooden bobbin storage unit 44 which is to be used next, and carries it to the shuttle 2 where the wooden bobbin 46 is fitted onto the tongue 18 and is laid inside the slot 17 into the same state as that of the wooden bobbin 21 indicated by the imaginary lines in FIG. 1 to place it ready for the next weaving process. Then, the securing air cylinder 22 is brought into its retracted state. While the cop is being replaced, the trimmed part of the new weft 45 is recovered by the trimmed weft recovery unit 54.

After the shuttle 2 carrying the new wooden bobbin 46 is restored into the shuttle box 1 by retracting the two air cylinders 11 and 12, vacuum is turned off, and the movements of the cylinders 11, 12 and 16 are reversed to bring the shuttle positioning unit 7 to its waiting position indicated by the arrow X in FIG. 2. According to the present embodiment, immediately before shooting the shuttle 2 from the shuttle box 1 to start the process of weaving, the gripper 69 of the slack removing unit 67 is lifted to its upper most position to remove slack from the weft, and the grip of the gripper 69 on the weft is released at the same time as the shooting of the shuttle 2. Therefore, slacking of the weft resulting from the replacement of the cop can be automatically removed when resuming the process of weaving. Thus, severe impulsive tensioning of the weft 4, hence the possibility of breaking the weft can be avoided.

According to the present embodiment, the device of the present invention is provided only in one of the shuttle boxes, and, in case of a failure of the device, replacement of the cops can be carried out manually in conventional manner on the other shuttle box which is provided with a sufficient space for that. Alternatively, a pair of such devices may be disposed on either side, and, in this case, the cops may be replaced on either side to more efficiently utilize the weft.

Thus, according to the present invention, since a series of steps related to the processes of positioning the shuttle, tying the wefts, and replacing the cops can be carried out automatically without involving any manual process, replacement of cops for weaving can be carried out automatically and the cost of the weaving process can be reduced to a significant extent. Also, since the various actions can be effected with a single robot arm, the cop changing device may be simplified and made highly compact.

What we claim is:

1. An automatic cop changing device for a weaving machine in which a shuttle carrying a cop consisting of a bobbin around which a weft is wound is reciprocated between warps so as to weave said weft between said warps, comprising:

cop positioning means for keeping said shuttle stationary near a terminal point of its reciprocating movement when the weft of a current cop mounted on said shuttle is consumed by more than a prescribed amount;

cop storage means for storing a plurality of new cops;

weft pulling means for drawing the weft from said current cop and a weft from one of said new cops stored in said cop storage means, and crossing said two wefts;

weft tying means for tying said crossed part of said wefts;

weft trimming means for trimming an extraneous part of said tied weft; and cop replacing means for removing said current cop from said shuttle, and mounting said new cop on said shuttle;

said cop replacing means consisting of a single robot arm comprising a base rotatable around a vertical axis, an arm assembly movable both radially and vertically with respect to said base, and a hand assembly carried by a free end of said arm assembly to manipulate said shuttles.

2. An automatic cop changing device according to claim 1, wherein said tying means consists of a welding unit.

3. An automatic cop changing device according to claim 1, further comprising slack removing means for taking up slack from said tied weft after said new cop is mounted on said shuttle and before said shuttle is shot from said terminal point of its reciprocating movement to another terminal point.

4. An automatic cop changing device according to claim 3, wherein said slack removing means comprising a stationary ring placed adjacent to a part of said weft from said new cop, a gripper which can selectively grip said weft from inside said stationary ring and release it as required, and gripper driving means for selectively moving said gripper away from and towards said stationary ring.

5. An automatic cop changing device according to claim 1, wherein said weft pulling means comprises a table, a weft gripping hand carried by a robot which can grip an end of said weft of said new cop stored in said cop storage means and a part of said weft extending from said current cop, a pair of locating pins projecting upright from said table to cross said wefts at three points by passing said wefts along different sides of said locating pins in a criss-cross manner with said weft gripping hand, disengaging arms placed under said wefts between said locating pins to selectively disengage said wefts from said locating pins by pushing off said weft from said locating pins.

6. An automatic cop changing device according to claim 5, wherein said weft pulling means comprises tied point varying means for changing the point of tying by said weft tying means by changing the length of a span of said weft between said point of tying of said weft and said current cop.

7. An automatic cop changing according to claim 6, wherein said tied point varying means comprises a stationary rod projecting upright from said table, a moveably rod projecting upright from said table so as to be able to move toward and away from said stationary rod to change said point of tying relative to said cop at said terminal point, and means of retracting said rods into said table to disengage said weft therefrom.

8. An automatic cop changing device according to claim 5, wherein said hand assembly further comprises said weft gripping hand.

9. An automatic cop changing device according to claim 8, wherein said weft gripping hand comprises a pair of pawls which are pivotally connected to each other by a pivot shaft so as to grip a weft between said pawls, and said spherical head of said cop raising hand is formed at an end of said pivot shaft.

10. An automatic cop changing device according to claim 1, wherein said hand assembly comprises a cop raising hand for moving a cop between a retracted position in said shuttle and an upright position in said shuttle, and a cop gripping hand for gripping a cop and carrying it between its upright position in said shuttle and a storage position in said cop storage means.

11. An automatic cop changing device according to claim 10, wherein said cop is pivotally and detachably supported at its base end by said shuttle so as to be pivotable between its upright position and its retracted position, and said cop raising hand comprises a spherical head which is adapted to engage a free end of said cop and move it between its upright position and its retracted position.

12. An automatic cop changing device for a weaving machine in which a shuttle carrying a cop consisting of a bobbin around which a weft is wound is reciprocated between warps so as to weave said weft between said warps, comprising:

cop positioning means for keeping said shuttle stationary near a terminal point of its reciprocating movement when the weft of a current cop mounted on said shuttle is consumed by more than a prescribed amount;

cop storage means for storing a plurality of new cops;

weft pulling means for drawing the weft from said current cop and a weft from one of said new cops stored in said cop storage means, and crossing said two wefts;

weft tying means for tying said crossed part of said wefts;

weft trimming means for trimming an extraneous part of said tied weft;

cop replacing means for removing said current cop from said shuttle, and mounting said new cop on said shuttle; and slack removing means for taking up slack from said tied weft after said new cop is mounted on said shuttle and before said shuttle is shot from terminal point of its reciprocating movement to another terminal point.

13. An automatic cop changing device according to claim 12, wherein said slack removing means comprises a stationary ring placed adjacent to a part of said weft from said new cop, a gripper which can selectively grip said weft from inside said stationary ring and release it as required, and gripper driving means for selectively moving said gripper away from and towards said stationary ring.

14. An automatic cop changing device according to claim 13, said weft pulling means comprises tied point varying means for changing the point of tying by said weft tying means by changing the length of a span of said weft between said point of tying of said weft and said current cop.

15. An automatic cop changing device according to claim 12, wherein said tied point varying means comprises a stationary rod projecting upright from a table, a moveable rod projecting upright from said table so as to be able to move toward and away from said stationary rod to change said point of tying relative to said cop at its terminal point, and means of retracting said rods into said table to disengage said weft therefrom.

16. An automatic cop changing device for a weaving machine in which a shuttle carrying a cop consisting of a bobbin around which a weft is wound is reciprocated between warps so as to weave said weft between said warps, comprising:

cop positioning means for keeping said shuttle stationary near a terminal point of its reciprocating movement when the weft of a current cop mounted on said shuttle is consumed by more than a prescribed amount;

cop storage means for storing a plurality of new cops;

a cop replacing robot for removing said current cop from said shuttle, and mounting said new cop on said shuttle, said cop replacing robot comprising a base rotatable around a vertical axis, an arm assembly movable both radially and vertically with respect to said base, and a hand assembly carried by a free end of said arm assembly to manipulate said shuttles and to draw a weft from said current cop and a weft from one of said new cops stored in said cop storage means;

weft securing means for temporarily securing said two wefts drawn by said hand assembly in a crossed state;

weft tying means for tying said crossed part of said wefts; and weft trimming means for trimming an extraneous part of said tied weft.

* * * * *